US012281807B2

(12) United States Patent
Kawashima et al.

(10) Patent No.: US 12,281,807 B2
(45) Date of Patent: Apr. 22, 2025

(54) INFERENCE DEVICE AND LEARNING DEVICE

(71) Applicant: Mitsubishi Electric Corporation, Tokyo (JP)

(72) Inventors: Atsushi Kawashima, Tokyo (JP); Genta Yoshimura, Tokyo (JP); Takuji Morimoto, Tokyo (JP); Keisuke Sugiura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 18/004,491

(22) PCT Filed: Sep. 14, 2020

(86) PCT No.: PCT/JP2020/034709
§ 371 (c)(1),
(2) Date: Jan. 6, 2023

(87) PCT Pub. No.: WO2022/054278
PCT Pub. Date: Mar. 17, 2022

(65) Prior Publication Data
US 2024/0240820 A1 Jul. 18, 2024

(51) Int. Cl.
*F24F 11/41* (2018.01)
*F24F 11/42* (2018.01)
*F24F 11/64* (2018.01)

(52) U.S. Cl.
CPC ..... *F24F 11/41* (2018.01); *F24F 11/42* (2018.01); *F24F 11/64* (2018.01)

(58) Field of Classification Search
CPC ..... F24F 11/41; F24F 11/42; F25B 47/022; F25B 47/025; F25B 49/02; F25B 2700/11
See application file for complete search history.

(56) References Cited

U.S. PATENT DOCUMENTS

2012/0227428 A1 9/2012 Yokoo et al.
2020/0173703 A1 6/2020 Sakabe et al.

FOREIGN PATENT DOCUMENTS

CN 104933322 A 9/2015
CN 110608511 A 12/2019
(Continued)

OTHER PUBLICATIONS

International Search Report of the International Searching Authority mailed Nov. 24, 2020 for the corresponding International Application No. PCT/JP2020/034709 (and English translation).
(Continued)

*Primary Examiner* — Jonathan Bradford
(74) *Attorney, Agent, or Firm* — Posz Law Group, PLC

(57) ABSTRACT

An inference device obtains an inference value of a time taken to melt frost for defrosting temperature information representing a temperature of an outdoor-side heat exchanger included by an outdoor unit of an air-conditioning apparatus or a state of change in the temperature. In the inference device, the time taken to melt frost is a period during which the temperature of the outdoor-side heat exchanger is stable within a first range. The inference device includes a first data acquisition unit that acquires the defrosting temperature information of the air-conditioning apparatus, and an inference unit that obtains, by using a trained model that infers a time taken to melt frost from the defrosting temperature information and in accordance with the defrosting temperature information acquired by the first data acquisition unit, an inference value of the time taken to melt frost for the defrosting temperature information.

13 Claims, 6 Drawing Sheets

(56) References Cited

FOREIGN PATENT DOCUMENTS

| | | | | |
|---|---|---|---|---|
| EP | 2829825 | A1 * | 1/2015 | ..... F24D 19/1039 |
| EP | 2851635 | A1 | 3/2015 | |
| EP | 2428754 | B1 | 8/2017 | |
| JP | S63-204052 | A | 8/1988 | |
| JP | F01-041748 | A | 2/1989 | |
| JP | H03-007840 | A | 1/1991 | |
| JP | H07-083484 | A | 3/1995 | |
| JP | 2002-130876 | A | 5/2002 | |
| JP | 2012-037066 | A | 2/2012 | |
| JP | 2015-158360 | A | 9/2015 | |
| JP | 2015-183873 | A | 10/2015 | |
| JP | 2017-040400 | A | 2/2017 | |
| WO | 2019/035195 | A1 | 2/2019 | |

OTHER PUBLICATIONS

Office Action dated Aug. 29, 2023 issued in corresponding Japanese Patent Application No. 2022-547361 (and English translation).
Office Action dated Feb. 26, 2025 issued in corresponding Chinese Patent Application No. 202080104245.2 (and English translation).

* cited by examiner

INFERENCE DEVICE AND LEARNING DEVICE

CROSS REFERENCE TO RELATED APPLICATION

This application is a U.S. national stage application of PCT/JP2020/034709 filed on Sep. 14, 2020 the contents of which are incorporated herein by reference.

TECHNICAL FIELD

The present disclosure relates to an inference device and a learning device for an air-conditioning apparatus having a defrosting function.

BACKGROUND ART

In air-conditioning apparatuses, in some cases, when a heating operation is performed in winter, frost deposits on an outdoor-side heat exchanger. For this reason, an air-conditioning apparatus has been proposed in which a defrost operation (defrosting operation) of melting frost deposited on an outdoor-side heat exchanger by using heat of an indoor heat exchanger incorporated into an indoor unit is performed (for example, see Patent Literature 1).

CITATION LIST

Patent Literature

Patent Literature 1: International Publication No. 2019/035195

SUMMARY OF INVENTION

Technical Problem

In Patent Literature 1, after a previous defrosting operation is finished, when a definite period of time has elapsed since resumption of a heating operation and a temperature detected by a temperature sensor reaches or falls below a prescribed value, it is determined that conditions for starting a defrosting operation are met, and a defrosting operation is started.

In control based on such rules, however, in some cases, even when very little frost deposits on an outdoor-side heat exchanger, a defrosting operation is started, thus resulting in inferior energy saving performance and comfort.

To address such an issue, the present disclosure provides an inference device and a learning device in which appropriate timing of starting a defrosting operation is determined to thus enable an improvement in energy saving performance.

Solution to Problem

An inference device according to an embodiment of the present disclosure is configured to obtain an inference value of a time taken to melt frost for defrosting temperature information representing a temperature of an outdoor-side heat exchanger included by an outdoor unit of an air-conditioning apparatus or a state of change in the temperature. In the inference device, the time taken to melt frost is a period during which the temperature of the outdoor-side heat exchanger is stable within a first range. The inference device includes a first data acquisition unit configured to acquire the defrosting temperature information of the air-conditioning apparatus, and an inference unit configured to, by using a trained model configured to infer a time taken to melt frost from the defrosting temperature information and in accordance with the defrosting temperature information acquired by the first data acquisition unit, obtain an inference value of the time taken to melt frost for the defrosting temperature information.

A learning device according to another embodiment of the present disclosure is configured to generate a trained model configured to obtain an inference value of a time taken to melt frost for defrosting temperature information representing a temperature of an outdoor-side heat exchanger included by an outdoor unit of an air-conditioning apparatus or a state of change in the temperature. In the learning device, the time taken to melt frost is a period during which the temperature of the outdoor-side heat exchanger is stable within a first range. The learning device includes a second data acquisition unit configured to acquire training data generated in accordance with a combination of the defrosting temperature information and an actual measured value of the time taken to melt frost, and a model generation unit configured to, by performing learning by using the training data so that an inference value of the time taken to melt frost for the defrosting temperature information approaches the actual measured value of the time taken to melt frost, generate a trained model configured to obtain an inference value of the time taken to melt frost from the defrosting temperature information of the air-conditioning apparatus.

Advantageous Effects of Invention

In the inference device and the learning device according to one or more embodiments of the present disclosure, as the amount of frost depositing on the outdoor-side heat exchanger, a time taken to melt frost is inferred to determine appropriate timing of starting a defrosting operation, enabling an improvement in energy saving performance.

DESCRIPTION OF EMBODIMENTS

An embodiment of an inference device 20 and a learning device 30 according to the present disclosure will be described below with reference to the drawings. The present disclosure is not to be limited to the embodiment described below, and various modifications can be made thereto within the scope of the gist of the present disclosure. Furthermore, the present disclosure includes, among configurations described in the embodiment below and modifications of the embodiment, all combinations of configurations that are combinable. Furthermore, in figures, elements denoted by the same reference signs are the same or corresponding elements, and this is common through the full text of the description. Incidentally, in each drawing, for example, the relative dimensional relationship between components or the shapes of the components may differ from the actual relationship or shapes.

Embodiment 1

The inference device 20 and the learning device 30 according to Embodiment 1 will be described below. The inference device 20 and the learning device 30 are incorporated into or connected to an air-conditioning apparatus 101 and are used.

<Configuration of Air-Conditioning Apparatus 101>

Figure 1:
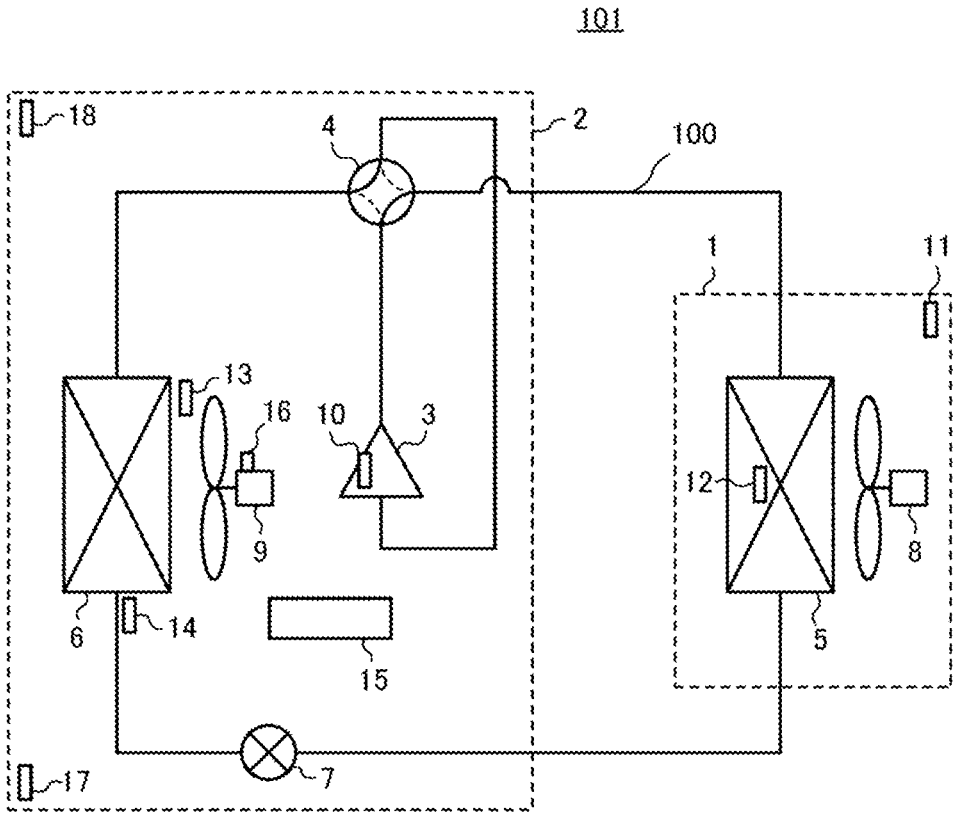
FIG. 1 is a schematic diagram illustrating an example of a configuration of a refrigerant circuit 100 of an air-conditioning apparatus 101 for which an inference device 20 and a learning device 30 according to Embodiment 1 are used.

FIG. 1 is a schematic diagram illustrating an example of a configuration of a refrigerant circuit 100 of the air-conditioning apparatus 101 for which the inference device 20 and the learning device 30 according to Embodiment 1 are used.

As illustrated in FIG. 1, the air-conditioning apparatus 101 includes an indoor unit 1 installed in an indoor space to be air-conditioned, and an outdoor unit 2 installed on an outdoor side. An environment where the outdoor unit 2 is installed is hereinafter referred to as an outdoor air environment. The indoor unit 1 includes an indoor-side heat exchanger 5. On the other hand, the outdoor unit 2 includes a compressor 3, a four-way valve 4, an outdoor-side heat exchanger 6, and an expansion valve 7. The compressor 3, the four-way valve 4, the outdoor-side heat exchanger 6, the expansion valve 7, and the indoor-side heat exchanger 5 are connected via refrigerant pipes and thus constitute the refrigerant circuit 100.

The indoor-side heat exchanger 5 exchanges heat between refrigerant flowing through a refrigerant pipe placed therein and indoor air. On the other hand, the outdoor-side heat exchanger 6 exchanges heat between refrigerant flowing through a refrigerant pipe placed therein and outdoor air. The indoor-side heat exchanger 5 and the outdoor-side heat exchanger 6 are, for example, fin-and-tube heat exchangers. Incidentally, each of the indoor-side heat exchanger 5 and the outdoor-side heat exchanger 6 may be divided into a plurality of heat exchangers. In this case, the plurality of heat exchangers are connected in series or in parallel.

The compressor 3 sucks refrigerant flowing through the refrigerant circuit 100. The compressor 3 compresses and discharges the sucked refrigerant. The compressor 3 is, for example, an inverter compressor. The refrigerant discharged from the compressor 3 is caused to flow into the indoor-side heat exchanger 5 or the outdoor-side heat exchanger 6.

The four-way valve 4 is a flow switching device configured to switch between a state for the case of a cooling operation of cooling the indoor space where the indoor unit 1 is installed and a state for the case of a heating operation of heating the indoor space. FIG. 1 illustrates a state in which the air-conditioning apparatus 101 is performing the heating operation. As illustrated in FIG. 1, when the air-conditioning apparatus 101 is performing the heating operation, the four-way valve 4 reaches a state represented by a solid line in FIG. 1, and refrigerant discharged from the compressor 3 flows into the indoor-side heat exchanger 5. At this time, the outdoor-side heat exchanger 6 functions as an evaporator, and the indoor-side heat exchanger 5 functions as a condenser. On the other hand, when the air-conditioning apparatus 101 is performing the cooling operation, the four-way valve 4 reaches a state represented by a dashed line in FIG. 1, and refrigerant discharged from the compressor 3 flows into the outdoor-side heat exchanger 6. At this time, the outdoor-side heat exchanger 6 functions as a condenser, and the indoor-side heat exchanger 5 functions as an evaporator. Incidentally, another flow switching device having a similar function may be used in place of the four-way valve 4.

The expansion valve 7 is a pressure reducing device that reduces the pressure of refrigerant and is, for example, an electronic expansion valve. The expansion valve 7 is provided between the outdoor-side heat exchanger 6 and the indoor-side heat exchanger 5. Incidentally, another pressure reducing device having a similar function may be used in place of the expansion valve 7.

The refrigerant circuit 100 is filled with refrigerant. The type of refrigerant is, for example, R32 or R410A and is not limited to a particular type.

The indoor unit 1 further includes an indoor-side fan 8 for sending air to the indoor-side heat exchanger 5. The indoor-side fan 8 is placed on the windward side of the indoor-side heat exchanger 5. Incidentally, the indoor-side fan 8 may be placed on the leeward side of the indoor-side heat exchanger 5.

The outdoor unit 2 further includes an outdoor-side fan 9 for sending air to the outdoor-side heat exchanger 6. The outdoor-side fan 9 is placed on the leeward side of the outdoor-side heat exchanger 6. Incidentally, the outdoor-side fan 9 may be placed on the windward side of the outdoor-side heat exchanger 6.

In the outdoor-side fan 9, a device is provided that detects or estimates a current value that was used by the outdoor-side fan 9 in sending air. This device is referred to as a current measurement device 16. The current measurement device 16 is, for example, a current sensor or a processor. Current information detected or estimated by the current measurement device 16 is output to a control unit 15 included in the outdoor unit 2. Incidentally, the current measurement device 16 may be provided in the control unit 15.

On an outer skin of the compressor 3 in the outdoor unit 2, a temperature sensor 10 is installed. The temperature sensor 10 detects a temperature of the compressor 3. Incidentally, the location where the temperature sensor 10 is installed may be any other area where a temperature of the compressor 3 can be detected. For example, the temperature sensor 10 may be provided on a refrigerant pipe along a path from the compressor 3 to the four-way valve 4 in place of the outer skin of the compressor 3. Compressor temperature information detected by the temperature sensor 10 is output to the control unit 15.

On the windward side of the indoor-side fan 8 in the indoor unit 1, a temperature sensor 11 is installed. The temperature sensor 11 detects an air temperature before the inflow of air into the indoor-side heat exchanger 5, that is, a room temperature. Incidentally, the location of the temperature sensor 11 is not limited to the area illustrated in FIG. 1 as long as a room temperature can be detected. Room temperature information detected by the temperature sensor 11 is output to the control unit 15.

On a pipe wall of a refrigerant pipe of the indoor-side heat exchanger 5, a temperature sensor 12 is installed. The temperature sensor 12 detects a temperature of the indoor-side heat exchanger 5 when the indoor-side heat exchanger 5 functions as a condenser during heating, that is, a condensing temperature. The location of the temperature sensor 12 is not limited to the area illustrated in FIG. 1 as long as the location is an area where a temperature of the indoor-side heat exchanger 5 can be detected. Condensing temperature information detected by the temperature sensor 12 is output to the control unit 15.

In the outdoor unit 2, a temperature sensor 13 for measuring a temperature of air sent by the outdoor-side fan 9 to the outdoor-side heat exchanger 6 is installed. The temperature sensor 13 is installed on the windward side of the outdoor-side heat exchanger 6 to measure an air temperature before the passage of air through the outdoor-side heat exchanger 6, that is, an outdoor air temperature. Incidentally, the location of the temperature sensor 13 is not limited to the area illustrated in FIG. 1 as long as an air temperature before the passage of air through the outdoor-side heat exchanger 6 can be detected. Outdoor air temperature information detected by the temperature sensor 13 is output to the control unit 15.

On a pipe wall of a refrigerant pipe of the outdoor-side heat exchanger 6, a temperature sensor 14 is installed. The temperature sensor 14 detects a temperature of the outdoor-side heat exchanger 6 when the outdoor-side heat exchanger 6 functions as an evaporator during heating, that is, an evaporating temperature. The location of the temperature sensor 14 is not limited to the area illustrated in FIG. 1 as long as the location is an area where a temperature of the outdoor-side heat exchanger 6 can be estimated. Evaporating temperature information detected by the temperature sensor 14 is output to the control unit 15.

Although, in FIG. 1, five temperature sensors 10 to 14 are provided, the number of the temperature sensors 10 to 14 is not limited to that illustrated in FIG. 1 and may be larger or smaller than that number. For example, when the outdoor-side heat exchanger 6 is divided into a plurality of heat exchangers, a plurality of temperature sensors 14 may be installed for the outdoor-side heat exchangers.

Furthermore, the types of sensors are not limited to the types illustrated in FIG. 1. For example, a humidity sensor 17 that measures humidity in the outdoor air environment where the outdoor unit 2 is installed, an illuminance sensor 18 that measures illuminance in the outdoor air environment, or other sensors may be installed in the outdoor unit 2. In this case, for example, both temperature information and humidity information in the outdoor air environment can be obtained by the temperature sensor 13 and the humidity sensor 17. Incidentally, it is desirable that illuminance measured by the illuminance sensor 18 is a value representing the amount of solar radiation to a casing of the outdoor unit 2. Pieces of information detected by these sensors 10 to 14 and 16 to 18 are collected in the control unit 15 included in the outdoor unit 2.

The control unit 15 is constituted by a control board. On the control board of the control unit 15, a controller, a storage device, and a drive circuit are mounted. The controller is, for example, dedicated hardware, or a Central Processing Unit (CPU) or microprocessor that executes a program stored in a memory. Furthermore, the storage device is a non-volatile or volatile semiconductor memory, such as a Random Access Memory (RAM), Read Only Memory (ROM), flash memory, or Erasable Programmable ROM (EPROM), or a disk, such as a magnetic disk, flexible disk, or optical disk.

<Operation of Air-Conditioning Apparatus 101>

Next, a general description of operation of the air-conditioning apparatus 101 illustrated in FIG. 1 will be provided.

As described above, refrigerant is contained within the refrigerant circuit 100 and is compressed by the compressor 3. During cooling, a refrigeration cycle formed by the following cooling operation circuit is provided. That is, refrigerant compressed by the compressor 3 is condensed and liquefied by the outdoor-side heat exchanger 6, expanded by the expansion valve 7, and further evaporated by the indoor-side heat exchanger 5. Subsequently, the refrigerant returns to the compressor 3. Incidentally, in a defrosting operation as well, the refrigeration cycle formed by the cooling operation circuit is provided.

On the other hand, during heating, a refrigeration cycle formed by the following heating operation circuit is provided. That is, refrigerant compressed by the compressor 3 is condensed and liquefied by the indoor-side heat exchanger 5, expanded by the expansion valve 7, and evaporated by the outdoor-side heat exchanger 6. Subsequently, the refrigerant returns to the compressor 3.

When performing cooling or heating as described above, the air-conditioning apparatus 101 illustrated in FIG. 1 controls each component so that a temperature detected by the temperature sensor 11 on an indoor side, that is, a room temperature reaches a target value. That is, the air-conditioning apparatus 101 controls a rotational speed of the compressor 3, an opening degree of the expansion valve 7, a volume of air sent by the indoor-side fan 8, and a volume of air sent by the outdoor-side fan 9.

This control is performed in accordance with temperatures detected by the temperature sensors 10 to 14, and cooling capacity or heating capacity of the air-conditioning apparatus 101 is controlled. Such control is performed by the control unit 15 of the outdoor unit 2.

During the heating operation, under conditions where air temperature is low and humidity is high, frost may deposit on the outdoor-side heat exchanger 6 functioning as an evaporator. In this case, resistance to the passage of air sent by the outdoor-side fan 9 increases, and the amount of heat to be exchanged in the outdoor-side heat exchanger 6 decreases, reducing heating capacity. Thus, in the air-conditioning apparatus 101, a defrosting operation of melting frost deposited on the outdoor-side heat exchanger 6 is performed.

<Defrosting Operation>

Figure 2:
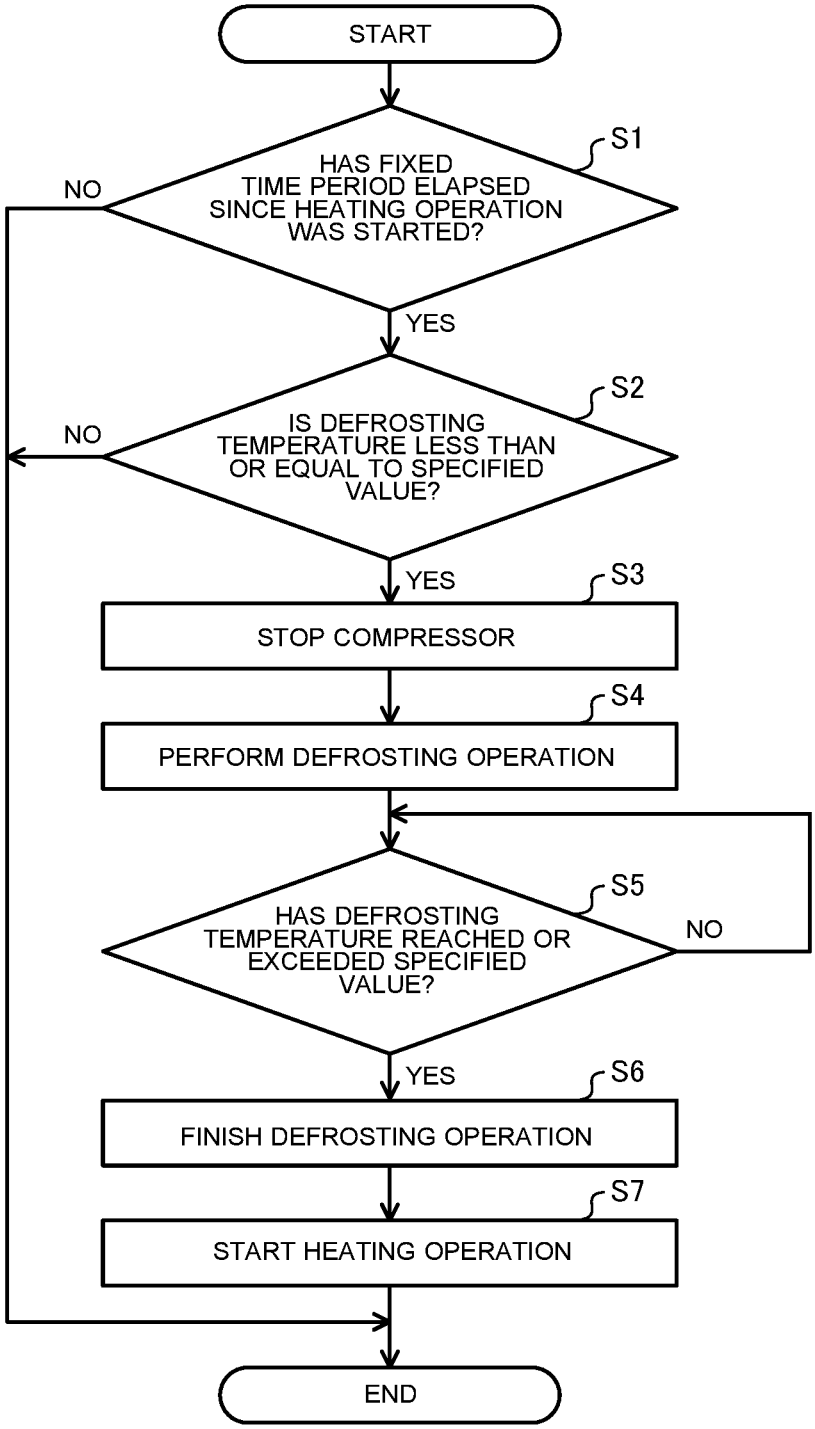
FIG. 2 is a flowchart illustrating an example of defrosting operation control performed by the air-conditioning apparatus 101 according to Embodiment 1.

FIG. 2 is a flowchart illustrating an example of defrosting operation control performed by the air-conditioning apparatus 101 according to Embodiment 1. The defrosting operation of FIG. 2 is an example of a typical operation, and a defrosting operation is not limited to this. A general description of the defrosting operation of FIG. 2 will be provided below. Incidentally, here, a temperature of the refrigerant pipe of the outdoor-side heat exchanger 6 detected by the temperature sensor 14 is referred to as a defrosting temperature θ. Hence, the defrosting temperature θ is a temperature of the outdoor-side heat exchanger 6 when the outdoor-side heat exchanger 6 functions as an evaporator during heating.

As illustrated in FIG. 2, the control unit 15 determines in step S1 whether a fixed time period has elapsed since the air-conditioning apparatus 101 started or resumed a heating operation. The fixed time period is a preset value. When the control unit 15 determines that the fixed time period has not elapsed, the control unit 15 ends a process of the flow of FIG. 2 without doing anything. On the other hand, when the control unit 15 determines that the fixed time period has elapsed, the control unit 15 proceeds to step S2.

In step S2, the control unit 15 determines whether a defrosting temperature θ detected by the temperature sensor 14 is less than or equal to a preset specified value. When the control unit 15 determines that the defrosting temperature θ is greater than the specified value, the control unit 15 ends the process of the flow of FIG. 2 without doing anything. On the other hand, when the control unit 15 determines that the defrosting temperature θ is less than or equal to the specified value, the control unit 15 proceeds to step S3.

In step S3, the control unit 15 determines, in accordance with determinations made in steps S1 and S2, that conditions for starting the defrosting operation are met, that is, that frost has deposited on the outdoor-side heat exchanger 6. The control unit 15 causes the compressor 3 to stop temporarily so that the defrosting operation is started.

In step S4, the control unit 15 performs switching of the four-way valve 4 to form the above-described cooling operation circuit and restarts the compressor 3 to start the defrosting operation. In the defrosting operation, frost depositing on the outdoor-side heat exchanger 6 is melted, for example, by using a reverse defrosting method of circulating refrigerant. In the defrosting operation, high-temperature, high-pressure refrigerant produced by the compressor 3 passes through a refrigerant pipe and flows into the outdoor-side heat exchanger 6. This refrigerant gives heat to frost depositing on the outdoor-side heat exchanger 6, and thus this frost melts into water.

The defrosting operation is continued until the defrosting temperature θ reaches or exceeds the above-described specified value. Thus, in step S5, the control unit 15 determines whether the defrosting temperature θ has reached or exceeded the specified value. In step S5, when the control unit 15 determines that the defrosting temperature θ has reached or exceeded the specified value, the control unit 15 proceeds to step S6.

In step S6, the control unit 15 determines that a condition for finishing the defrosting operation is met, and finishes the defrosting operation to proceed to step S7. In finishing the defrosting operation, the control unit 15 first stops the compressor 3 and performs switching of the four-way valve 4 to switch the operation circuit back to the above-described heating operation circuit.

In step S7, the control unit 15 restarts the compressor 3 to resume the heating operation.

In the related art as well, such defrosting operation control is performed. In the control, however, in midwinter, or under a low outdoor air temperature environment, such as cold climates, a defrosting operation may be started even when no frost deposits. Even in this case, a heating operation is temporarily stopped during the defrosting operation, thus resulting in an unwanted reduction in room temperature. Furthermore, extra energy, such as energy during the defrosting operation, or energy for changing the reduced room temperature due to the defrosting operation to a set value, is necessary.

Thus, in the inference device 20 according to Embodiment 1, an inference value Pest of "time taken to melt frost" to be described is obtained by using a trained model. The control unit 15 of the air-conditioning apparatus 101 determines, in accordance with the inference value Pest of "time taken to melt frost", whether or not to start the flow of FIG. 2. This can avoid the performance of an unnecessary defrosting operation with no frost depositing on the outdoor-side heat exchanger 6. A detailed description will be provided below.

<Time Taken to Melt Frost>

Figure 3:
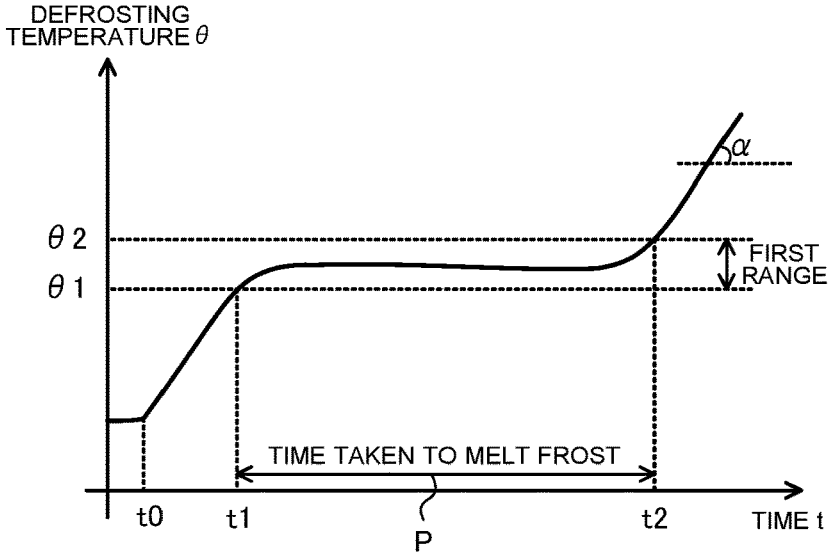
FIG. 3 illustrates an example of changes over time in defrosting temperature θ during a defrosting operation.

FIG. 3 illustrates an example of changes over time in defrosting temperature θ during a defrosting operation. In FIG. 3, the horizontal axis represents time, and the vertical axis represents defrosting temperature θ. Note that a pattern of changes over time in defrosting temperature θ varies according to values of various parameters, such as an outdoor air temperature, the amount of frost depositing on the outdoor-side heat exchanger 6, and the number of compressors 3 being driven during the defrosting operation, and thus the pattern is not limited to that illustrated in FIG. 3. Hereinafter, for the sake of explanation, the case illustrated in FIG. 3 will be described as an example.

As illustrated in FIG. 3, when the defrosting operation is started at a time to, the defrosting temperature θ after the start of the defrosting operation increases. Subsequently, refrigerant flowing through the refrigerant pipe of the outdoor-side heat exchanger 6 gives heat to frost depositing on the outdoor-side heat exchanger 6 to melt the frost. Thus, the defrosting temperature θ is temporarily stabilized in the neighborhood of 0 degrees C. and increases again after the frost deposited on the outdoor-side heat exchanger 6 melts. Subsequently, as described above, when the defrosting temperature θ reaches or exceeds the specified value, the defrosting operation is finished.

In Embodiment 1, as illustrated in FIG. 3, two temperatures θ1 and θ2 are defined in the neighborhood of 0 degrees C. At this time, the temperature θ1 is set to a temperature lower than the temperature θ2 (θ1<θ2). At this time, the temperatures θ1 and θ2 are set so that, for example, the relationship of θ1≤θ<θ2 holds. Incidentally, the temperature θ1 is a temperature immediately before stabilization of the defrosting temperature θ. The temperature θ2 is a temperature immediately before a further increase in the defrosting temperature θ. Assume that a time when the defrosting temperature θ reaches the temperature θ1 is t1 and that a time when the defrosting temperature θ reaches the temperature θ2 is t2. At this time, a period during which the time t satisfies the relationship of t1≤t≤t2 is a period during which the defrosting temperature θ exists in the neighborhood of a melting point and is specifically a period during which θ1≤θ≤θ2 holds. This period is a period during which refrigerant flowing through the refrigerant pipe of the outdoor-side heat exchanger 6 is giving heat to frost depositing on the outdoor-side heat exchanger 6 to melt the frost. Hereinafter, this period is referred to as "time taken to melt frost" and is denoted by a reference sign "P" in FIG. 3.

Hence, assuming that a range of greater than or equal to the temperature 61 and less than or equal to the temperature θ2 is "first range", the time taken to melt frost P is a period during which the defrosting temperature θ, which is defrosting temperature information, is stable within the first range. A period of the time taken to melt frost P is a period during which a change of state occurs in which frost depositing on the outdoor-side heat exchanger 6 changes into water. Hence, during the time taken to melt frost P; heat energy of refrigerant flowing through the refrigerant pipe is consumed not as sensible heat due to which the defrosting temperature θ changes, but as latent heat due to which a change of state occurs in which frost changes into water. Thus, the time taken to melt frost P is a period during which the frost depositing on the outdoor-side heat exchanger 6 is melted while the defrosting temperature θ, which is defrosting temperature information, is shifting such that the defrosting temperature θ remains stuck in the neighborhood of the melting point. Consequently, during the time taken to melt frost P, the defrosting temperature θ, which is defrosting temperature information, is stable within the first range.

As described above, the temperature θ1 and the temperature θ2 are appropriately set so that, for example, the relationship of θ1≤θ<θ2 holds. However, the relationship between the temperatures θ1 and θ2 is not limited to this. The melting point may vary somewhat from 0 degrees C. under the influence of an impurity, such as dirt, and thus the temperature θ1 and the temperature θ2 may be set so that any one of relationships of θ1<θ≤θ2, θ1<θ2≤θ, and θ≤θ1<θ2 holds. Note that the temperatures θ1 and θ2 are set in a range of from −20 degrees C. to +20 degrees C., and it is desirable that the temperatures θ1 and θ2 are set in a range of from −5 degrees C. to +5 degrees C. or in a range of from −10 degrees C. to +10 degrees C. In any of the ranges, "first range" is a range including the melting point or 0 degrees C.

The time taken to melt frost P varies according to the amount of frost depositing on the outdoor-side heat exchanger 6. When the amount of frost is large, it takes a long time to completely melt the frost, and thus the time taken to melt frost P increases. On the other hand, when the amount of frost is small, the time taken to melt frost P decreases. Incidentally, when the amount of frost is small and the time taken to melt frost P is extremely short, after the defrosting temperature θ reaches or exceeds the temperature θ1, the defrosting temperature θ may reach or exceed the temperature θ2 without being temporarily stabilized in the neighborhood of 0 degrees C. as illustrated in FIG. 3.

Incidentally, in some settings of the specified value for the defrosting temperature θ and some values taken on by the temperatures θ1 and θ2, the defrosting temperature θ has already satisfied θ1≤θ<θ2 at the time to. In this case, the time taken to melt frost P is counted from the time to. That is, t1=t0 holds.

Furthermore, the stopping and starting of the compressor 3 during the defrosting operation, and a series of transient phenomena in the compressor 3 make a refrigerant state, for example, unstable, and thus the state of the defrosting temperature θ may change from θ<θ1 to θ1≤θ<θ2 temporarily and then satisfy θ<θ1 again. In this case, a time when θ1≤θ<θ2 is satisfied for the second time is a starting point t1 of counting of the time taken to melt frost P. In a case where such a phenomenon occurs more than once, a time when θ1≤θ<θ2 is satisfied for the last time is the starting point t1 of counting.

Furthermore, the stopping and starting of the compressor 3 during the defrosting operation, and a series of transient phenomena in the compressor 3 make a refrigerant state, for example, unstable, and thus the state of the defrosting temperature θ may change from θ1≤θ<θ2 to θ2≤θ temporarily and then satisfy θ1≤θ<θ2 again. In this case, a time when θ2≤θ is satisfied for the second time is an end point t2 of counting of the time taken to melt frost P. In a case where such a phenomenon occurs more than once, a time when θ2≤θ is satisfied for the last time is the end point t2 of counting.

Incidentally, the way the starting and end points of counting of the time taken to melt frost P are determined is an example and is not limited to the above.

The control unit 15 stores, by using the storage device provided in the control unit 15, values, such as a control value, for example, for an operating frequency of the compressor 3, a current value of the outdoor-side fan 9, values detected, for example, by the temperature sensors 10 to 14, and a time taken to melt frost.

<Inference Phase>

Next, the inference device 20 according to Embodiment 1 will be described. The inference device 20 according to Embodiment 1 obtains an inference value Pest of the above-described time taken to melt frost P illustrated in FIG. 3 and outputs the inference value Pest of the time taken to melt frost P to the air-conditioning apparatus 101. Then, only when the inference value Pest of the time taken to melt frost P output from the inference device 20 is greater than or equal to a preset threshold value Th, the air-conditioning apparatus 101 according to Embodiment 1 implements the process of the flow of FIG. 2. Hence, in Embodiment 1, when all the following three conditions (a) to (c) are met, a defrosting operation is performed. This can avoid an unnecessary defrosting operation.

(a): The inference value Pest of the time taken to melt frost P is greater than or equal to the preset threshold value Th.

(b): The fixed time period has elapsed since the air-conditioning apparatus 101 started a heating operation (YES in step S1 in FIG. 2).

(c): A current defrosting temperature θ detected by the temperature sensor 14 is less than or equal to the preset specified value (YES in step S2 in FIG. 2).

Figure 4:
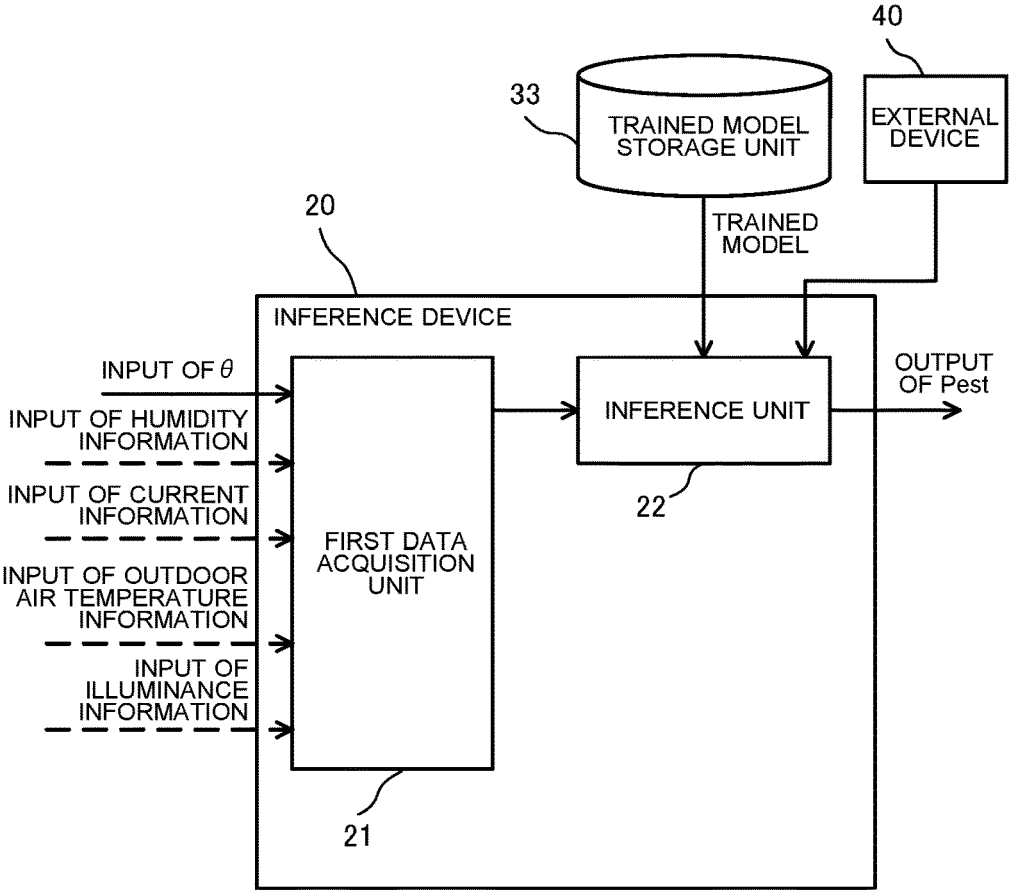
FIG. 4 is a block diagram illustrating a configuration of the inference device 20 according to Embodiment 1.

A configuration of the inference device 20 according to Embodiment 1 will be described below with reference to FIG. 4. FIG. 4 is a block diagram illustrating the configuration of the inference device 20 according to Embodiment 1. As illustrated in FIG. 4, the inference device 20 includes a first data acquisition unit 21 and an inference unit 22. Furthermore, a trained model storage unit 33 or an external device 40 is connected to the inference device 20.

Incidentally, as one of components of the air-conditioning apparatus 101 illustrated in FIG. 1, the inference device 20 may be included by the air-conditioning apparatus 101. In this case, the inference device 20 is built, for example, in the outdoor unit 2 of the air-conditioning apparatus 101. Alternatively, the inference device 20 may be provided separately from the air-conditioning apparatus 101. For example, the inference device 20 may exist on a cloud server. In this case, the control unit 15 of the air-conditioning apparatus 101 and the inference device 20 are connected to each other in such a manner as to be able to communicate with each other.

The first data acquisition unit 21 acquires, as defrosting temperature information, a defrosting temperature θ detected by the temperature sensor 14. Incidentally, as described above, the defrosting temperature @ is a temperature of the outdoor-side heat exchanger 6 detected by the temperature sensor 14. The first data acquisition unit 21 may acquire the defrosting temperature θ directly from the temperature sensor 14, but may acquire the defrosting temperature θ from the temperature sensor 14 via the control unit 15.

The inference unit 22 obtains, by using a trained model, an inference value Pest of a time taken to melt frost. Specifically, the inference unit 22 inputs the defrosting temperature θ acquired by the first data acquisition unit 21 to the trained model and thereby obtains an inference value Pest of a time taken to melt frost P from the defrosting temperature θ.

The trained model is generated by the learning device 30 to be described and is described in the trained model storage unit 33. The inference unit 22 acquires the trained model from the trained model storage unit 33. Alternatively, the inference unit 22 acquires the trained model from the external device 40 via a communication line, such as the Internet. Examples of the external device 40 include one or more other air-conditioning apparatuses, a cloud server, and a website of a manufacturer of the air-conditioning apparatus 101.

Here, a hardware configuration of the inference device 20 will be described. The inference device 20 is constituted by a processing circuit that implements a function of each of the first data acquisition unit 21 and the inference unit 22. The processing circuit is dedicated hardware or a processor. The dedicated hardware is, for example, an Application Specific Integrated Circuit (ASIC) or a Field Programmable Gate Array (FPGA). The processor executes a program stored in a memory. Furthermore, the inference device 20 includes a storage unit (not illustrated) that stores, for example, the program and calculated results. The storage unit is a memory. The memory is a non-volatile or volatile semiconductor memory, such as a Random Access Memory (RAM), Read Only Memory (ROM), flash memory, or Erasable Programmable ROM (EPROM), or a disk, such as a magnetic disk, flexible disk, or optical disk.

Figure 5:
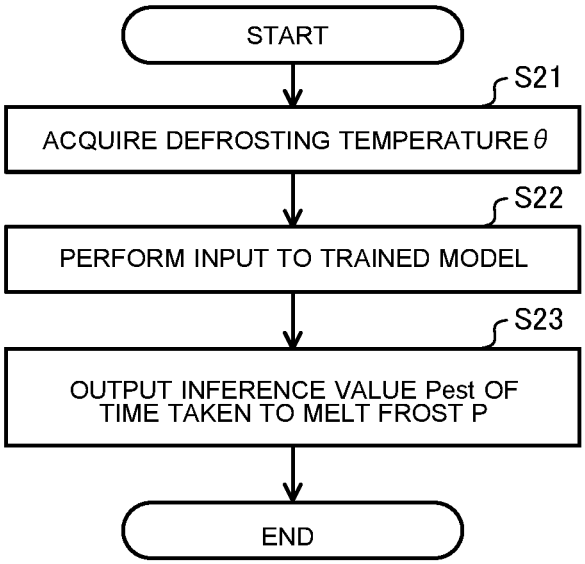
FIG. 5 is a flowchart illustrating the flow of a process performed by the inference device 20 according to Embodiment 1.

Next, the flow of a process performed by the inference device 20 will be described with reference to FIG. 5. FIG. 5 is a flowchart illustrating the flow of the process performed by the inference device 20 according to Embodiment 1. A process of the flow of FIG. 5 is repeatedly performed, for example, at fixed periods when the air-conditioning apparatus 101 is performing a heating operation.

As illustrated in FIG. 5, first, the first data acquisition unit 21 acquires a current defrosting temperature θ detected by the temperature sensor 14 in step S21. The defrosting temperature θ at this time is a temperature of the outdoor-side heat exchanger 6 of the air-conditioning apparatus 101 when the outdoor-side heat exchanger 6 functions as an evaporator, that is, a temperature before the start of a defrosting operation.

Next, in step S22, the inference unit 22 inputs the defrosting temperature θ acquired in step S21 to a trained model stored in the trained model storage unit 33 and obtains an inference value Pest of a time taken to melt frost P. Incidentally, the trained model will be described later.

Next, in step S23, the inference unit 22 outputs the inference value Pest of the time taken to melt frost P obtained by using the trained model to the control unit 15 of the air-conditioning apparatus 101.

Figure 6:
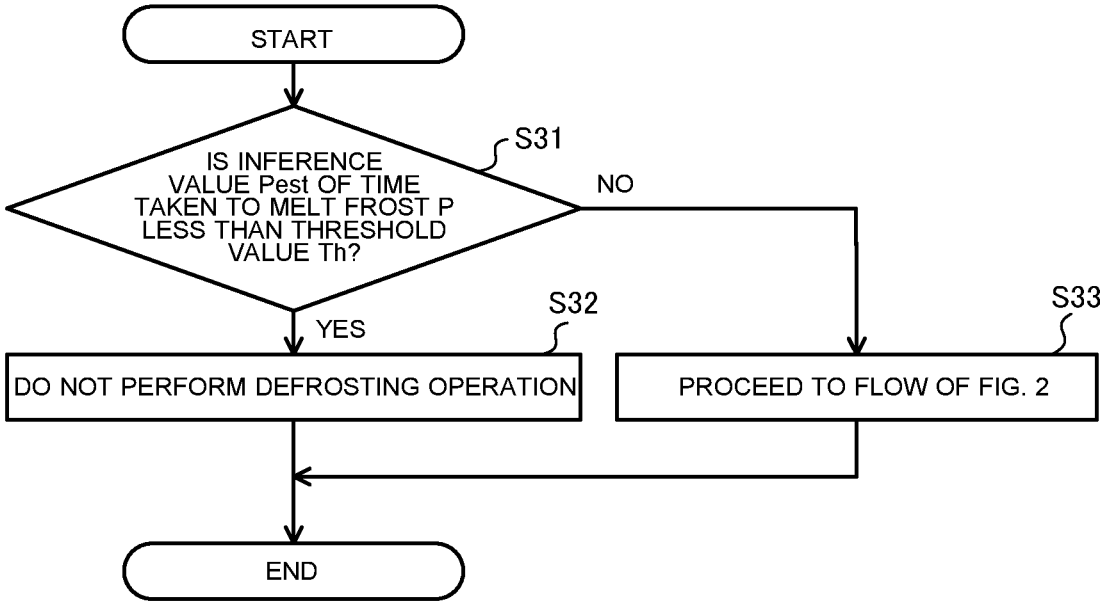
FIG. 6 is a flowchart illustrating the flow of a process performed by the air-conditioning apparatus 101 according to Embodiment 1.

The control unit 15 of the air-conditioning apparatus 101 receives the inference value Pest of the time taken to melt frost P from the inference device 20 and performs a process of FIG. 6. FIG. 6 is a flowchart illustrating the flow of a process performed by the air-conditioning apparatus 101 according to Embodiment 1.

As illustrated in FIG. 6, the control unit 15 of the air-conditioning apparatus 101 determines in step S31 whether or not the inference value Pest of the time taken to melt frost P received from the inference device 20 is less than the preset threshold value Th. When the control unit 15 determines that the inference value Pest of the time taken to melt frost P is less than the threshold value Th, the control unit 15 proceeds to step S32. On the other hand, when the control unit 15 determines that the inference value Pest of the time taken to melt frost P is greater than or equal to the threshold value Th, the control unit 15 proceeds to step S33.

In step S32, the control unit 15 determines that a defrosting operation is not to be performed, and ends the process of FIG. 6 without doing anything.

In step S33, the control unit 15 proceeds to the process of the flow of FIG. 2. In the flow of FIG. 2, when the condition of step S1 and the condition of step S2 are met, the control unit 15 performs a defrosting operation.

Thus, in Embodiment 1, the air-conditioning apparatus 101 compares the inference value Pest of the time taken to melt frost P output from the inference device 20 with the threshold value Th. Then, when the inference value Pest of the time taken to melt frost P is less than the threshold value Th, a defrosting operation is not performed even when the fixed time period has elapsed since a heating operation was started (YES in S1 in FIG. 2) and the defrosting temperature θ is less than or equal to the specified value (YES in S2 in FIG. 2). This can avoid an unnecessary defrosting operation, reduce power consumption, and also keep the comfort of a user from decreasing due to a defrosting operation.

On the other hand, when the inference value Pest of the time taken to melt frost P is greater than or equal to the threshold value Th, a defrosting operation is performed when the fixed time period has elapsed since a heating operation was started (YES in S1 in FIG. 2) and the defrosting temperature θ is less than or equal to the specified value (YES in S2 in FIG. 2). In other words, when conditions for starting defrosting are met in existing defrosting control performed by air-conditioning apparatuses and it is determined, in accordance with an inference, that defrosting is to be started, a shift to a defrosting action is made. This enables defrosting to be performed at appropriate timing when a defrosting operation is necessary.

Thus, in Embodiment 1, the inference device 20 obtains, as the amount of frost depositing, an inference value Pest of a time taken to melt frost P to determine appropriate timing of starting a defrosting operation, enabling an improvement in energy saving performance.

Incidentally, in Embodiment 1, although a defrosting temperature θ is used as defrosting temperature information, a value itself of the defrosting temperature θ does not have to be used. The defrosting temperature information may be a value representing a state of change in the temperature of the outdoor-side heat exchanger 6. That is, the defrosting temperature information may be, for example, at least any one of an average value, a cumulative value, an integral, or a maximum value or minimum value of the defrosting temperature θ in a time segment that has elapsed since completion of a previous defrosting operation up to the present time. Furthermore, the defrosting temperature information may be a gradient a of the defrosting temperature θ with respect to the time t as illustrated in FIG. 3. The gradient a represents the ratio of the amount of change in the defrosting temperature θ to the amount of change in the time t. Incidentally, as illustrated in FIG. 3, during the time taken to melt frost P, the gradient a is 0 or nearly 0.

Furthermore, the inference device 20 may obtain the inference value Pest of the time taken to melt frost P by using humidity information in addition to the defrosting temperature information. As humidity in the outdoor air environment increases, the amount of frost depositing on the outdoor-side heat exchanger 6 increases. For this reason, as the humidity increases, the time taken to melt frost P tends to increase. In this case, the first data acquisition unit 21 acquires defrosting temperature information from the temperature sensor 14 and further acquires, as humidity information, from the humidity sensor 17, humidity in the outdoor air environment where the outdoor unit 2 is installed. Furthermore, in this case, the trained model is a trained model for inferring a time taken to melt frost from the defrosting temperature information and the humidity information. The inference unit 22 obtains, by using this trained model, the inference value Pest of the time taken to melt frost P.

Alternatively, the inference device 20 may infer the time taken to melt frost P by using current information of the outdoor-side fan 9 included by the outdoor unit 2 of the air-conditioning apparatus 101 in addition to the defrosting temperature information. When the amount of frost depositing on the outdoor-side heat exchanger 6 increases, the passage of air through the outdoor-side heat exchanger 6 worsens, a load of the outdoor-side fan 9 increases, and a current value increases. Hence, there is a high possibility that the amount of frost depositing on the outdoor-side heat exchanger 6 increases as the current value increases with respect to a rotation speed of the outdoor-side fan 9, and the time taken to melt frost P tends to increase. In this case, the first data acquisition unit 21 acquires defrosting temperature information from the temperature sensor 14 and further acquires, as current information, from the current measurement device 16, a current value that was used by the outdoor-side fan 9 in sending air. Furthermore, in this case, the trained model is a trained model for inferring a time taken to melt frost from the defrosting temperature information and the current information. The inference unit 22 obtains, by using this trained model, the inference value Pest of the time taken to melt frost P.

Furthermore, the inference device 20 may infer the time taken to melt frost P by using outdoor air temperature information in addition to the defrosting temperature information. As an outdoor air temperature increases, the time taken to melt frost P decreases. In this case, the first data acquisition unit 21 acquires defrosting temperature information from the temperature sensor 14 and further acquires, as outdoor air temperature information, an outdoor air temperature from the temperature sensor 13. Furthermore, in this case, the trained model is a trained model for inferring a time taken to melt frost from the defrosting temperature information and the outdoor air temperature information. The inference unit 22 obtains, by using this trained model, the inference value Pest of the time taken to melt frost P.

Furthermore, the inference device 20 may infer the time taken to melt frost P by using illuminance information in addition to the defrosting temperature information. In general, as illuminance increases, the time taken to melt frost P tends to decrease. In this case, the first data acquisition unit 21 acquires defrosting temperature information from the temperature sensor 14 and further acquires, as illuminance information, from the illuminance sensor 18, illuminance in the outdoor air environment where the outdoor unit 2 is installed. Furthermore, in this case, the trained model is a trained model for inferring a time taken to melt frost from the defrosting temperature information and the illuminance information. The inference unit 22 obtains, by using this trained model, the inference value Pest of the time taken to melt frost P.

Thus, the inference device 20 only has to use at least one of defrosting temperature information, humidity information, current information, outdoor air temperature information, and illuminance information to obtain, by using the trained model, the inference value Pest of the time taken to melt frost P. Combinations of these pieces of information can be appropriately changed. Furthermore, the inference device 20 may acquire these pieces of information directly from the respective sensors, but may acquire them via the control unit 15.

Furthermore, the inference device 20 outputs the inference value Pest of the time taken to melt frost P by using a trained model trained in a model generation unit 32 of the learning device 30. However, the inference device 20 is not limited to this case. As described above, the inference device 20 may acquire a trained model from the external device 40 to output the inference value Pest of the time taken to melt frost P in accordance with this trained model.

<Leaming Phase>

Figure 7:
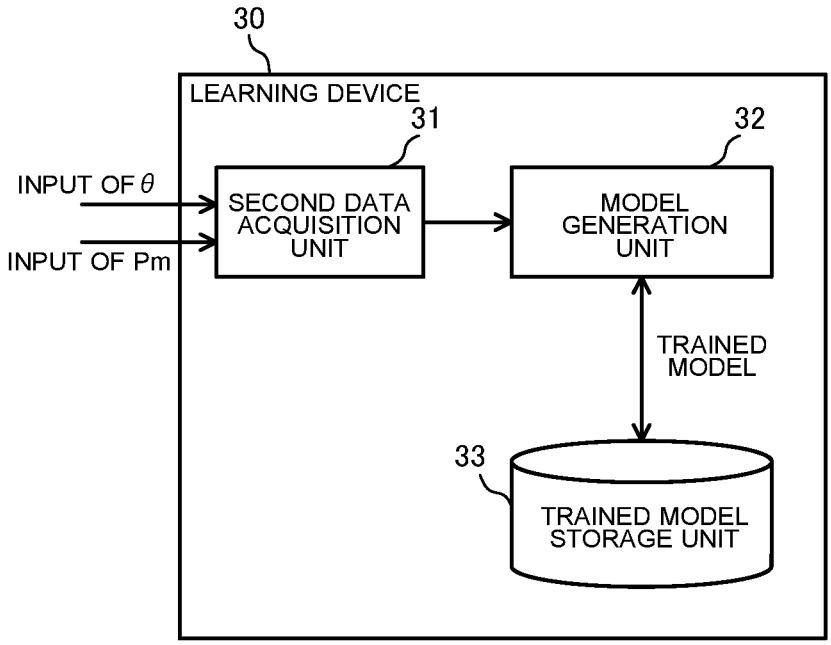
FIG. 7 is a block diagram illustrating a configuration of the learning device 30 according to Embodiment 1.

A configuration of the learning device 30 according to Embodiment 1 will be described below with reference to FIG. 7. FIG. 7 is a block diagram illustrating the configuration of the learning device 30 according to Embodiment 1. As illustrated in FIG. 7, the learning device 30 includes a second data acquisition unit 31, the model generation unit 32, and the trained model storage unit 33.

The second data acquisition unit 31 acquires a defrosting temperature θ as defrosting temperature information, and an actual measured value Pm of a time taken to melt frost P. Furthermore, the second data acquisition unit 31 combines the defrosting temperature θ with the actual measured value Pm of the time taken to melt frost P to generate training data. Here, the defrosting temperature @ is a surface temperature of the outdoor-side heat exchanger 6 included by the air-conditioning apparatus 101 and a value detected by the temperature sensor 14. Furthermore, the actual measured value Pm of the time taken to melt frost P is a period during which the temperature of the outdoor-side heat exchanger 6 actually existed in the neighborhood of the melting point during a defrosting operation performed by the air-conditioning apparatus 101. Hence, the actual measured value Pm of the time taken to melt frost P is specifically a time length of a period during which, for the temperature θ1 and the temperature θ2 illustrated in FIG. 3, the defrosting temperature θ detected by the temperature sensor 14 satisfied the relationship of $\theta 1 \leq \theta \leq \theta 2$. The actual measured value Pm of the time taken to melt frost P is measured by the control unit 15 of the air-conditioning apparatus 101. That is, the control unit 15 calculates, in accordance with the defrosting temperature θ detected by the temperature sensor 14, the actual measured value Pm of the time taken to melt frost P. The second data acquisition unit 31 may acquire, from the control unit 15, the defrosting temperature θ and the actual measured value Pm of the time taken to melt frost P. Alternatively, the defrosting temperature θ may be acquired directly from the temperature sensor 14.

The model generation unit 32 learns the time taken to melt frost P in accordance with the training data generated in accordance with a combination of the defrosting temperature θ and the actual measured value Pm of the time taken to melt frost P output from the second data acquisition unit 31. That is, the model generation unit 32 generates, from the defrosting temperature θ and the actual measured value Pm of the time taken to melt frost P in the air-conditioning apparatus 101, a trained model for inferring an optimal time taken to melt frost P. Here, the training data is data in which the defrosting temperature θ and the actual measured value Pm of the time taken to melt frost P are associated with each other.

Incidentally, an example has been described here where defrosting temperature information is a defrosting temperature θ. However, the defrosting temperature information is not limited to that case. The defrosting temperature information may be a current defrosting temperature θ, or a value representing a state of change in the defrosting temperature θ. That is, the defrosting temperature information may be a current defrosting temperature θ, or at least any one of an average value, a cumulative value, an integral, or a maximum value or minimum value of the defrosting temperature θ in a time segment that has elapsed since completion of a previous defrosting operation up to the present time.

Incidentally, the learning device 30 is used for learning the time taken to melt frost P in the air-conditioning apparatus 101. The learning device 30 may be included as one component by the air-conditioning apparatus 101, but may be provided separately from the air-conditioning apparatus 101. In this case, the learning device 30 is connected to the air-conditioning apparatus 101, for example, together with the inference device 20 via a network. Furthermore, both the learning device 30 and the inference device 20 may be built in the air-conditioning apparatus 101. Additionally, the learning device 30 and the inference device 20 may exist on a cloud server.

As a learning algorithm that the model generation unit 32 uses for learning, a known algorithm, such as supervised learning, unsupervised learning, or reinforcement learning, can be used. As an example, a case will be described where a neural network is used.

The model generation unit 32 learns, by using so-called supervised learning, the time taken to melt frost P, for example, in accordance with a neural network model. Here, the supervised learning is a method in which, when a dataset of inputs and outputs (labels) is provided to the learning device 30, features included in training data for them are learned, and an output is inferred from an input.

A neural network is composed of an input layer including a plurality of neurons, an intermediate layer (hidden layer) including a plurality of neurons, and an output layer including a plurality of neurons. The number of intermediate layers may be one or more than one.

Figure 8:
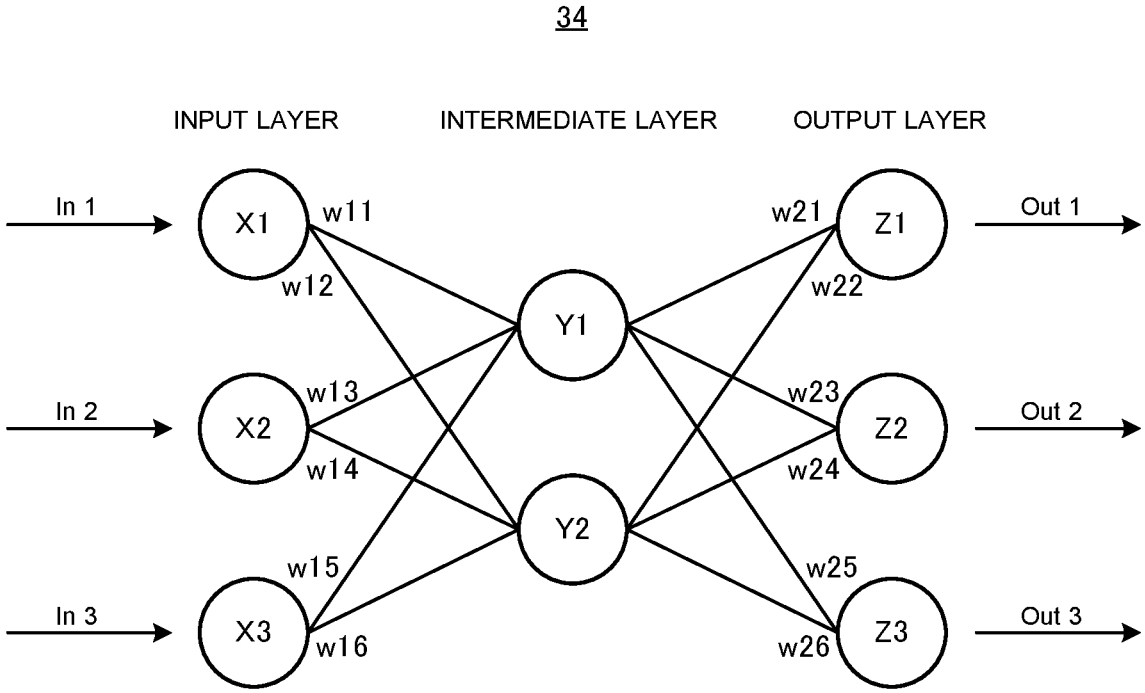
FIG. 8 schematically illustrates an example of a model of a neural network 34 included by a model generation unit 32.

FIG. 8 schematically illustrates an example of a model of a neural network 34 included by the model generation unit 32. Here, as an example, a case will be described where the neural network 34 of the model generation unit 32 is, for example, a three-layer neural network as illustrated in FIG. 8. The neural network 34 includes three input layers X1, X2, and X3, two intermediate layers Y1 and Y2, and three output layers Z1, Z2, and Z3.

Then, when a plurality of inputs In1, In2, and In3 are input to the respective input layers X1, X2, and X3, the inputs In1, In2, and In3 are multiplied by a predetermined first weight W1 in the input layers X1, X2, and X3. In the example of FIG. 8, the first weight W1 of the input layer X1 includes two types of weights: w11 and w12. Similarly, the first weight W1 of the input layer X2 includes two types of weighs: w13 and w14, and the first weight W1 of the input layer X3 includes two types of weighs: w15 and w16. Multiplication results obtained by performing multiplications by the first weight W1 are input to the intermediate layers Y1 and Y2. Here, the multiplication results are referred to as first multiplication results.

In the intermediate layers Y1 and Y2, the first multiplication results are multiplied by a predetermined second weight W2. In the example of FIG. 8, the second weight W2 of the intermediate layer Y1 includes three types of weights: w21, w23, and w25. Similarly, the second weight W2 of the intermediate layer Y2 includes three types of weights: w22, w24, and w26. Multiplication results obtained by performing multiplications by the second weight W2 are input to the output layers Z1, Z2, and Z3. Here, the multiplication results are referred to as second multiplication results. The second multiplication results are output as output results Out1, Out2, and Out3 from the output layers Z1, Z2, and Z3. The output results Out1, Out2, and Out3 change according to values of the weights W1 and W2.

In Embodiment 1, the neural network 34 learns, by using so called supervised learning, the time taken to melt frost P in accordance with training data generated in accordance with a combination of the defrosting temperature θ and the time taken to melt frost Pm acquired by the second data acquisition unit 31.

In other words, the neural network 34 learns the time taken to melt frost P for the defrosting temperature θ by using the following procedure. First, the first weight W1 and the second weight W2 are adjusted so that the output results Out1, Out2, and Out3 output from the output layers Z1, Z2, and Z3 when defrosting temperatures θ are input to the input layers X1, X2, and X3 approach actual measured values Pm of times taken to melt frost P. Thus, the first weight W1 and the second weight W2 are set, and the times taken to melt frost P for the defrosting temperatures θ are learned.

The model generation unit 32 performs the above-described learning and thus generates and outputs a trained model of a time taken to melt frost P for a defrosting temperature θ.

The trained model storage unit 33 stores the trained model output from the model generation unit 32.

Here, a hardware configuration of the learning device 30 will be described. The learning device 30 is constituted by a processing circuit that implements a function of each of the second data acquisition unit 31 and the model generation unit 32. The processing circuit is dedicated hardware or a processor. The dedicated hardware is, for example, an Application Specific Integrated Circuit (ASIC) or a Field Programmable Gate Array (FPGA). The processor executes a program stored in a memory. Furthermore, the learning device 30 includes a storage device (not illustrated) that stores, for example, the program and calculated results. The storage device implements a function of the trained model storage unit 33. The storage device is a memory. The memory is a non-volatile or volatile semiconductor memory, such as a Random Access Memory (RAM), Read Only Memory (ROM), flash memory, or Erasable Programmable ROM (EPROM), or a disk, such as a magnetic disk, flexible disk, or optical disk.

Figure 9:
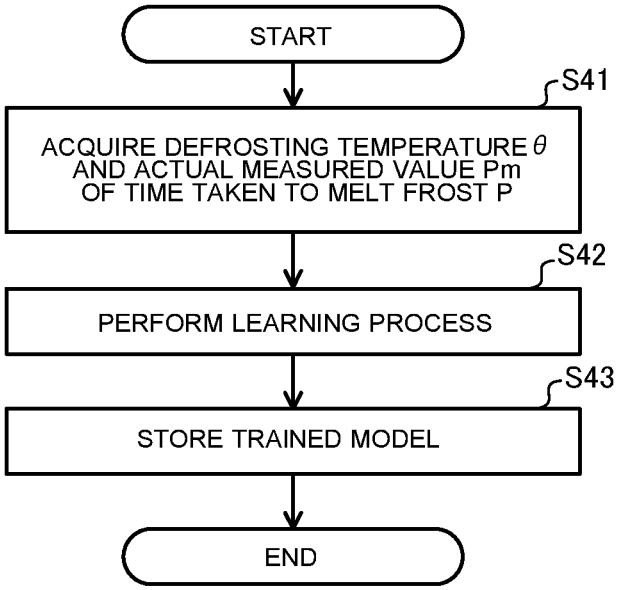
FIG. 9 is a flowchart illustrating the flow of a process performed by the learning device 30 according to Embodiment 1.

Next, the flow of a process performed by the learning device 30 will be described with reference to FIG. 9. FIG. 9 is a flowchart illustrating the flow of the process performed by the learning device 30 according to Embodiment 1.

As illustrated in FIG. 9, in step S41, the second data acquisition unit 31 acquires a defrosting temperature θ from the temperature sensor 14 and acquires an actual measured value Pm of a time taken to melt frost P from the control unit 15. Incidentally, although the defrosting temperature θ and the actual measured value Pm of the time taken to melt frost P are simultaneously acquired, the acquisition of these values is not limited to that case. The second data acquisition unit 31 only has to acquire the defrosting temperature θ and the actual measured value Pm of the time taken to melt frost P so that they are associated with each other, and thus the second data acquisition unit 31 may acquire data of the defrosting temperature θ and data of the actual measured value Pm of the time taken to melt frost P at different points of time.

Next, in step S42, the model generation unit 32 performs a learning process by using training data. The training data includes the defrosting temperature θ and the actual measured value Pm of the time taken to melt frost P. Incidentally, more specifically, the training data is a training data generated in accordance with a combination of the defrosting temperature θ and the actual measured value Pm of the time taken to melt frost P acquired by the second data acquisition unit 31. The model generation unit 32 learns, by using so called supervised learning, the time taken to melt frost P for the defrosting temperature θ by using this training data to generate a trained model.

Next, in step S43, the trained model storage unit 33 stores the trained model generated by the model generation unit 32.

Incidentally, in Embodiment 1, a case has been described where supervised learning is used as a learning algorithm used by the model generation unit 32. However, the learning algorithm is not limited to this. For the learning algorithm used by the model generation unit 32, for example, reinforcement learning, unsupervised learning, or semi-supervised learning other than supervised learning can be used.

Furthermore, in a case where a plurality of air-conditioning apparatuses 101 exist in the same area or in different areas, the model generation unit 32 may learn times taken to melt frost P in accordance with pieces of training data generated for the plurality of air-conditioning apparatuses 101. That is, the second data acquisition unit 31 may acquire pieces of training data from the plurality of air-conditioning apparatuses 101 used in the same area so that the model generation unit 32 learns times taken to melt frost P. Alternatively, the second data acquisition unit 31 may acquire pieces of training data collected from the plurality of air-conditioning apparatuses 101 that operate independently in different areas. Furthermore, the second data acquisition unit 31 can add an air-conditioning apparatus 101 whose training data is to be collected to a list halfway through the process, or can remove an air-conditioning apparatus from the list halfway through the process. Additionally, the learning device 30 having learned a time taken to melt frost P for a certain air-conditioning apparatus 101 may be used for a different air-conditioning apparatus 101 from this and may learn a time taken to melt frost P for this different air-conditioning apparatus 101 again to perform updating.

Furthermore, as a learning algorithm used by the model generation unit 32, Deep Learning in which extraction of a feature itself is learned can be used, and machine learning may be performed in accordance with other known methods, such as genetic programming, functional logic programming, and a support vector machine.

As described above, the inference device 20 according to Embodiment 1 includes the first data acquisition unit 21 that acquires defrosting temperature information of the air-conditioning apparatus 101. Furthermore, the inference unit 22 of the inference device 20 obtains, by using a trained model and in accordance with the defrosting temperature information acquired by the first data acquisition unit 21, an inference value Pest of a time taken to melt frost P for the defrosting temperature information. The air-conditioning apparatus 101 compares the inference value Pest of the time taken to melt frost P obtained by the inference device 20 with a threshold value Th. When the inference value Pest is less than the threshold value Th, the air-conditioning apparatus 101 does not start a defrosting operation even when a fixed time period has elapsed since a heating operation was started and a defrosting temperature θ is less than or equal to a specified value. This can keep an unnecessary defrosting operation from being performed. As a result, the power consumption of the air-conditioning apparatus 101 is reduced, making it possible to keep the comfort of the user from decreasing due to an unnecessary defrosting operation.

On the other hand, when the inference value Pest of the time taken to melt frost P obtained by the inference device 20 is greater than or equal to the threshold value Th, the air-conditioning apparatus 101 performs a defrosting operation when the fixed time period has elapsed since a heating operation was started (YES in S1 in FIG. 2) and the defrosting temperature θ is less than or equal to the specified value (YES in S2 in FIG. 2). This enables defrosting to be performed at appropriate timing when a defrosting operation is necessary.

Furthermore, the learning device 30 according to Embodiment 1 includes the second data acquisition unit 31 that acquires training data generated in accordance with a combination of defrosting temperature information and an actual measured value Pm of a time taken to melt frost P. Additionally, the model generation unit 32 of the learning device 30 performs learning by using the training data so that an inference value Pest of the time taken to melt frost P for the defrosting temperature information approaches the actual measured value Pm of the time taken to melt frost P. Thus, the model generation unit 32 generates a trained model that obtains an inference value Pest of the time taken to melt frost P from the defrosting temperature information of the air-conditioning apparatus 101. The learning device 30 generates a trained model by using the training data including the actual measured value Pm of the time taken to melt frost P and thus can obtain an inference value Pest close to the actual measured value Pm of the time taken to melt frost P with high accuracy.

Thus, in the inference device 20 and the learning device 30 according to Embodiment 1, as the amount of frost depositing, the inference value Pest of the time taken to melt frost P is obtained to determine appropriate timing of starting a defrosting operation, enabling an improvement in energy saving performance.

REFERENCE SIGNS LIST

1: indoor unit, 2: outdoor unit, 3: compressor, 4: four-way valve, 5: indoor-side heat exchanger, 6: outdoor-side heat exchanger, 7: expansion valve, 8: indoor-side fan, 9: outdoor-side fan, 10: temperature sensor, 11: temperature sensor, 12: temperature sensor, 13: temperature sensor, 14: temperature sensor, 15: control unit, 16: current measurement device, 17: humidity sensor, 18: illuminance sensor, 20: inference device, 21: first data acquisition unit, 22: inference unit, 30: learning device, 31: second data acquisition unit, 32: model generation unit, 33: trained model storage unit, 34: neural network, 40: external device, 100: refrigerant circuit, 101: air-conditioning apparatus

The invention claimed is:

1. An inference circuit configured to obtain an inference value of a time required to melt frost for defrosting temperature information representing a temperature of an outdoor-side heat exchanger included by in an outdoor unit of an air-conditioning apparatus or a state of change in the temperature, wherein the time required to melt frost is a period during which frost deposited on the outdoor-side heat exchanger is melted by refrigerant flowing through a refrigerant pipe of the outdoor-side heat exchanger and the temperature of the outdoor-side heat exchanger is stable within a first range, and wherein the inference circuit comprises:

a first data acquisition circuit configured to acquire the defrosting temperature information of the air-conditioning apparatus; and an inference circuit configured to, by using a trained model configured to infer the time required to melt frost from the defrosting temperature information and in accordance with the defrosting temperature information acquired by the first data acquisition circuit, obtain the inference value of the time required to melt frost for the defrosting temperature information.

2. The inference circuit of claim 1, wherein the defrosting temperature information includes a defrosting temperature representing a current temperature of the refrigerant pipe of the outdoor-side heat exchanger, or at least any one of an average value, a cumulative value, an integral, or a maximum value or minimum value of the defrosting temperature in a time segment that has elapsed since completion of a previous defrosting operation up to a present time.

3. The inference circuit of claim 1, wherein the trained model is a model configured to receive input of the defrosting temperature information and output an inference value of the time required to melt frost for the defrosting temperature information, and wherein the trained model is a model trained, in accordance with training data generated in accordance with a combination of the defrosting temperature information and an actual measured value of the time required to melt frost, so that an inference value of the time required to melt frost for the defrosting temperature information approaches an actual measured value of the time required to melt frost.

4. The inference circuit of claim 1, wherein the defrosting temperature information includes a gradient representing a ratio of an amount of change in the defrosting temperature information to an amount of change in time.

5. The inference circuit of claim 1, wherein the first data acquisition circuit is configured to acquire the defrosting temperature information, and humidity information representing humidity in an outdoor air environment where the outdoor unit of the air-conditioning apparatus is installed, and wherein the inference circuit is configured to, by using the trained model configured to infer the time required to melt frost from the defrosting temperature information and the humidity information and in accordance with the defrosting temperature information and the humidity information acquired by the first data acquisition circuit, obtain an inference value of the time required to melt frost.

6. The inference circuit of claim 1, wherein the first data acquisition circuit is configured to acquire the defrosting temperature information, and current information representing a current value used by an outdoor-side fan included by the outdoor unit of the air-conditioning apparatus, and wherein the inference circuit is configured to, by using the trained model configured to infer the time required to melt frost from the defrosting temperature information and the current information and in accordance with the defrosting temperature information and the current information acquired by the first data acquisition circuit, obtain an inference value of the time required to melt frost.

7. The inference circuit of claim 1, wherein the first data acquisition circuit is configured to acquire the defrosting temperature information, and outdoor air temperature information representing an outdoor air temperature in an outdoor air environment where the outdoor unit of the air-conditioning apparatus is installed, and wherein the inference circuit is configured to, by using the trained model configured to infer the time required to melt frost from the defrosting temperature information and the outdoor air temperature information and in accordance with the defrosting temperature information and the outdoor air temperature information acquired by the first data acquisition circuit, obtain an inference value of the time required to melt frost.

8. The inference circuit of claim 1, wherein the first data acquisition circuit is configured to acquire the defrosting temperature information, and illuminance information representing illuminance in an outdoor air environment where the outdoor unit of the air-conditioning apparatus is installed, and wherein the inference circuit is configured to, by using the trained model configured to infer the time required to melt frost from the defrosting temperature information and the illuminance information and in accordance with the defrosting temperature information and the illuminance information acquired by the first data acquisition circuit, obtain an inference value of the time required to melt frost.

9. The inference circuit of claim 1, wherein the inference circuit is further configured to infer the time required to melt frost from only the defrosting temperature information as measured over a fixed time period.

10. A learning circuit configured to generate a trained model configured to obtain an inference value of a time required to melt frost for defrosting temperature information representing a temperature of an outdoor-side heat exchanger included in an outdoor unit of an air-conditioning apparatus or a state of change in the temperature, wherein the time required to melt frost is a period during which frost deposited on the outdoor-side heat exchanger is melted by refrigerant flowing through a refrigerant pipe of the outdoor-side heat exchanger and the temperature of the outdoor-side heat exchanger is stable within a first range, and wherein the learning circuit comprises:

a data acquisition circuit configured to acquire training data generated in accordance with a combination of the defrosting temperature information and an actual measured value of the time required to melt frost; and a model generation circuit configured to, by performing learning by using the training data so that an inference value of the time required to melt frost for the defrosting temperature information approaches the actual measured value of the time required to melt frost, generate a trained model configured to obtain an inference value of the time required to melt frost from the defrosting temperature information of the air-conditioning apparatus.

11. The learning circuit of claim 10, wherein the training data includes the defrosting temperature information in a plurality of environments.

12. The learning circuit of claim 10, wherein the data acquisition circuit is further configured to acquire the training data in accordance with only the combination of the defrosting temperature information and the actual measured value of the time required to melt frost.

13. An air-conditioning apparatus comprising:

a refrigerant circuit including a compressor, a condenser, an expansion valve and an evaporator, a temperature sensor configured to detect an evaporating temperature of the evaporator, a receiving circuit configured to receive an inference value of the time required to melt frost from the inference circuit of claim 1, and a controller configured to start a defrosting operation of melting frost deposited on the evaporator when (a): the inference value of the time required to melt frost is greater than or equal to a threshold value, (b): a fixed time period has elapsed since a heating operation is started, and (c): the evaporating temperature detected by the temperature sensor is less than or equal to a preset specified value.

* * * * *